US005971362A

United States Patent [19]

Clark

[11] Patent Number: 5,971,362

[45] Date of Patent: Oct. 26, 1999

[54] WALL PANEL JACK

[76] Inventor: Marshall C. Clark, 235 N. U.S. 1, Ormond Beach, Fla. 32174

[21] Appl. No.: 08/964,642

[22] Filed: Nov. 5, 1997

[51] Int. Cl.[6] ..... B66F 3/36

[52] U.S. Cl. ..... 254/100; 254/133

[58] Field of Search ..... 254/100, 101, 254/106, 133 F, 133 A; 403/43; 248/354.1, 352, 351

[56] References Cited

U.S. PATENT DOCUMENTS

| | | | |
|---|---|---|---|
| 502,200 | 7/1893 | Pearson | 254/100 |
| 840,770 | 1/1907 | Ives | 254/100 |
| 2,617,620 | 11/1952 | Jessop | 254/98 |
| 2,974,931 | 3/1961 | Reel et al. | 254/106 |
| 4,629,163 | 12/1986 | Miller et al. | 254/101 |
| 5,663,012 | 9/1997 | Pasternak et al. | 29/281.4 |
| 5,732,932 | 3/1998 | Michalo | 254/93 R |

*Primary Examiner*—David A. Scherbel
*Assistant Examiner*—Lee Wilson
*Attorney, Agent, or Firm*—Paul S. Rooy

[57] ABSTRACT

A wall panel jack comprising a turnbuckle connecting a cradle shaft to a foot shaft, a cradle pivotably attached to an extreme of the cradle shaft opposite the turnbuckle, and a foot pivotably attached to an extreme of the foot shaft opposite the turnbuckle. The turnbuckle incorporates a turnbuckle bore with a turnbuckle bore cradle thread and a turnbuckle bore foot thread. The cradle shaft has a cradle shaft thread sized to mate with the turnbuckle bore cradle thread, and the foot shaft has a foot shaft thread sized to mate with the turnbuckle bore foot thread. The cradle incorporates a cradle groove sized to admit the lower edge of a wall panel, and the foot incorporates a foot pad made of non-slip material. Rotation of the turnbuckle varies the distance between the cradle groove and the foot pad. The method includes the steps of placing a suction cup handle in the cradle groove; positioning the wall panel jack vertically, the cradle topmost, with the foot on a floor and the suction cup against the wall panel; moving the foot away from the wall until the wall panel jack is disposed at an angle of 5–10 degrees relative to the wall; attaching the suction cup to the wall panel; lifting the wall panel into a position slightly higher than its intended installed height by rotating the turnbuckle; placing blocks on the floor under the wall panel; lowering the wall panel onto the blocks by rotating the turnbuckle; and fastening the wall panel to the wall.

6 Claims, 3 Drawing Sheets

FIG 2
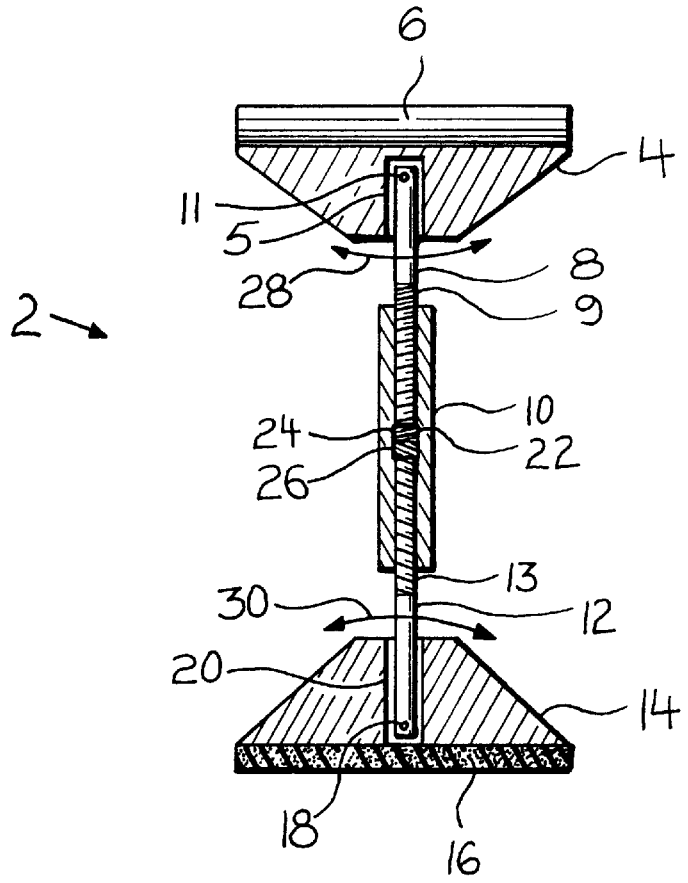
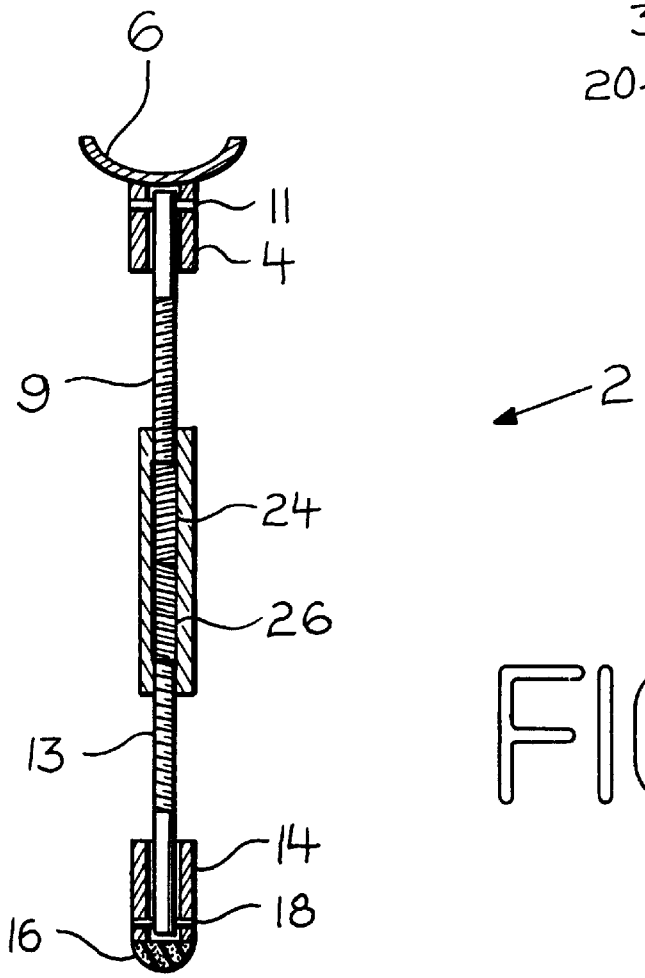
FIG 3

WALL PANEL JACK

BACKGROUND OF THE INVENTION

1. Field of the Invention

This invention relates to jacks, and in particular to a wall panel jack.

2. Background of the Invention

Until approximately the midpoint of the current millenium, fireplaces were required in every room which was inhabited during the winter-time in cold climates. Reasons for this included the inefficient insulation available during that time period, as well as the inherent inefficiency of fireplace heating. Castle walls were typically bare stone, and wooden buildings featured rough-hewn wood interior walls.

With the advent of wall hangings such as tapestries and curtains, and more efficient space heating, for the first time people could enjoy the luxury of individual bedrooms without having to worry about freezing during the long, cold winter nights.

As time went by, more and more wall hangings became available. Modern homes frequently feature mirrors or other decorative glass panels permanently mounted to interior wall surfaces. Other interior wall construction options include smooth panels which enhance the aesthetics of the wall surface.

Along with the numerous smooth-surfaced wall hangings which have become commercially available have come the problems associated with their installation. Large wall hangings may be very heavy, especially if made out of glass (such as is the case with mirrors) or dense synthetics.

Existing Practice

Current wall installation practice for large, smooth panels involves the steps of affixing a suction cup to the panel to be installed, holding the panel in place slightly higher than its final installed position, placing blocks under the panel, lowering the panel onto the blocks, and then permanently attaching the panel to the wall using conventional means, i.e. glue, panel-mounted clips which lock onto wall-mounted track, etc.

As may be readily appreciated, where a wall panel weighs anything more than a nominal amount, at least two installers will be required: one to hold up the panel; the other to place the blocks. And where the panel to be installed weighs a substantial amount, such as is frequently the case with large wall mirrors, two or more installers may be necessary to hold the panel in place while it is being blocked up in the installed position.

There are a number of problems associated with the current methods of wall panel installation. As has already been mentioned, a minimum of two installers are almost always required where the panel to be installed weighs a substantial amount. Thus the cost of installation is virtually doubled, because almost the entire installation cost is labor. Another problem associated with current installation methods is the possible health hazard of lifting a heavy wall panel into place, and then and holding it in position until it can be properly blocked. Many days of missed work are caused each year due to work-related lifting injuries.

Finally, current installation practice requires that one or more installers manually hold a wall panel to be installed in place until it is blocked. The hand tends to wander, especially when holding up a heavy weight. Thus, the current installation methods are susceptible to the risk that a panel may not be installed in precisely the desired location.

SUMMARY OF THE INVENTION

Accordingly, it is an object of the present invention to provide a wall panel jack which holds a wall panel in position while blocks are placed. Design features allowing this object to be accomplished include a cradle, a turnbuckle, and a foot. Advantages associated with the accomplishment of this object include reducing the number of installers required to install the wall panel, and thus reducing the cost and time of installation.

It is another object of the present invention to provide a wall panel jack which is capable of steadily holding a wall panel to be installed in a precise position while the wall panel is being blocked. Design features allowing this object to be accomplished include a cradle, turnbuckle, a foot and a foot pad. A benefit associated with the accomplishment of this object is more precise and accurate wall panel installation.

It is still another object of this invention to provide a wall panel jack which holds a wall panel to be installed in position while being blocked, with minimum operator effort. Design features enabling the accomplishment of this object include a cradle, a turnbuckle, and a foot. Advantages associated with the realization of this object include reduced chance of installer lifting injury, and consequent cost reduction to society at large.

It is yet another object of this invention to provide a wall panel jack which is easily affordable. Design features allowing this object to be achieved include the use of components made of readily available materials, and the use of a simple design. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Three sheets of drawings are provided. Sheet one contains FIG. 1. Sheet two contains FIGS. 2 and 3. Sheet three contains FIG. 4.

FIG. 2 is a front cross-sectional view of a wall panel jack.

FIG. 3 is a side cross-sectional view of a wall panel jack.

DETAILED DESCRIPTION OF THE PREFERRED EMBODIMENT

Figure 1:
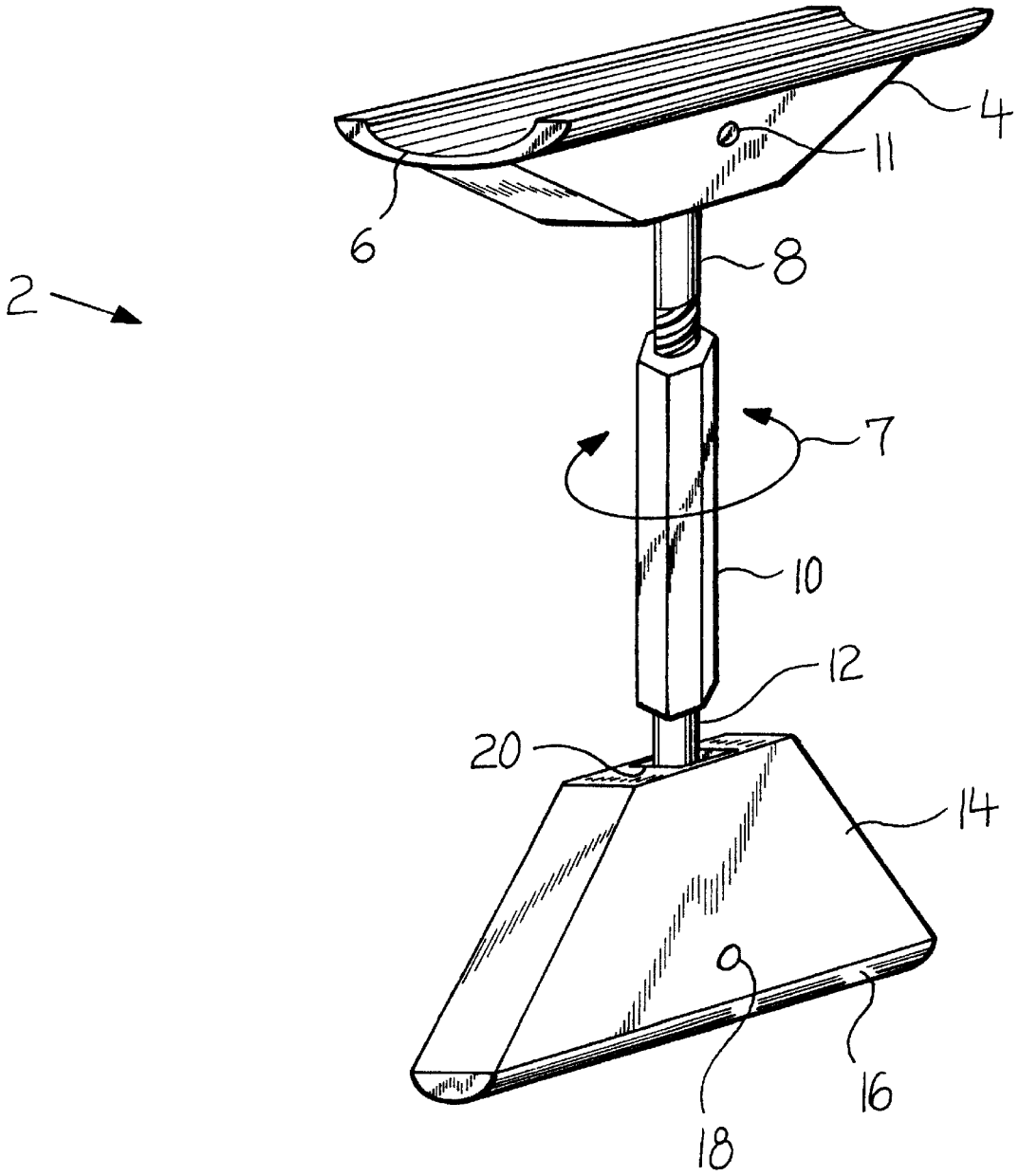
FIG. 1 is a front quarter isometric view of a wall panel jack.

Referring now to FIG. 1, we observe a front quarter isometric view of wall panel jack 2. Wall panel jack 2 comprises turnbuckle 10 connecting cradle shaft 8 to foot shaft 12. Cradle 4 is pivotably attached to an extreme of cradle shaft 8 opposite turnbuckle 10, and foot 14 pivotably attached to an extreme of foot shaft 12 opposite turnbuckle 10.

Referring now also to FIGS. 2 and 3, turnbuckle 10 comprises turnbuckle bore 22. Turnbuckle bore cradle thread 24 is disposed on an upper half of turnbuckle bore 22, and turnbuckle bore foot thread 26 is disposed on a lower half of turnbuckle bore 22. Cradle shaft thread 9 is disposed on cradle shaft 8, and is sized to mate with turnbuckle bore cradle thread 24. Foot shaft thread 13 is disposed on foot shaft 12, and is sized to mate with turnbuckle bore foot thread 26.

As may be noted in FIGS. 2 and 3, the sense of rotation of turnbuckle bore cradle thread 24 is opposite the sense of rotation of turnbuckle bore foot thread 26. It necessarily follows that the sense of rotation of cradle shaft thread 9 is opposite the sense of rotation of foot shaft thread 13, because as was previously specified, cradle shaft thread 9 mates with turnbuckle bore cradle thread 24, and foot shaft thread 13 mates with turnbuckle bore foot thread 26.

Thus, when turnbuckle 10 is rotated relative to cradle shaft 8 and foot shaft 12 as indicated by arrow 7 in FIG. 1, the distance between cradle shaft 8 and foot shaft 12 may be varied, and consequently the distance between cradle 4 and foot 14 may be varied. Where cradle 4 supports a wall panel 32 during installation on wall 38 as is depicted in FIG. 4, rotation of turnbuckle 10 as indicated by arrow 42 precisely sets the height above floor 40 at which wall 32 is held immobilized in position.

As may be observed in FIGS. 2 and 3, cradle shaft 8 is pivotably attached to cradle 4 by means of cradle dowel 11 in cradle aperture 5. Cradle groove 6 is disposed along an upper surface of cradle 4, and is sized to admit a lower edge of wall panel 32 to be supported during installation. The pivot range of cradle shaft 8 relative to cradle 4 is bounded by the walls of cradle aperture 5, and extends to ±5 degrees from perpendicular relative to cradle groove 6, as indicated by arrow 28 in FIG. 2.

Foot shaft 12 is pivotably attached to foot 14 by means of foot dowel 18 in foot aperture 20. Foot pad 16 is disposed along a lower surface of foot 14, and is made of a non-slip material such as rubber or vinyl, so as to prevent foot 14 from slipping on a floor 40 upon which it rests. The pivot range of foot shaft 12 relative to foot 14 is bounded by the walls of foot aperture 20, and extends to ±5 degrees from perpendicular relative to foot pad 16, as indicated by arrow 30 in FIG. 2.

Figure 4:
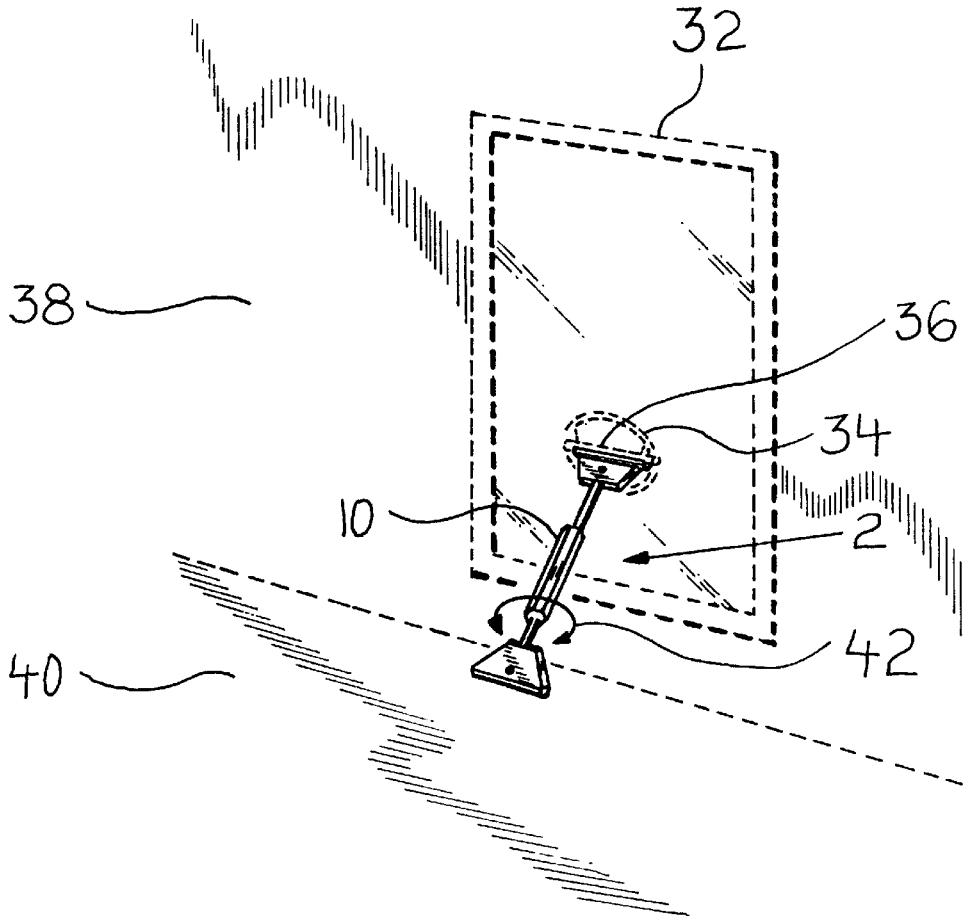
FIG. 4 is a front quarter view of wall panel jack being used to support a wall panel in place during the installation process.

FIG. 4 is a front quarter view of wall panel jack 2 being used to support a wall panel 32 in place during the installation process. In this example wall panel 32 is a mirror. Suction cup 34 having suction cup handle 36 is well-known in the art, and is used during the installation process. First suction cup handle 36 is placed in cradle groove 6. Then wall panel jack 2 is positioned vertically, cradle 4 topmost, with foot pad 16 on floor 40 and suction cup 34 against wall panel 32. Foot 14 is moved away from wall 38 until wall panel jack 2 is disposed at an angle of 5–7 degrees to wall 38. Suction cup 34 is attached to wall panel 32 in the conventional manner. Wall panel 32 is then lifted into a position slightly higher than it's intended installed height by rotating turnbuckle 10 as indicated by arrow 42, and correctly-sized blocks are placed on floor 40 under wall panel 32. Finally, wall panel 32 is lowered onto the blocks by rotating turnbuckle 10, and, blocked in place, wall panel 32 is permanently fastened to wall 38. In this fashion, a single installer can safely, accurately, and conveniently install even heavy wall panels 32.

In the preferred embodiment, cradle 4, cradle dowel 11, cradle shaft 8, turnbuckle 1 0, foot shaft 12, foot 14, and foot dowel 18 were fabricated of steel, aluminum, synthetic, or other appropriate material. Foot pad 16 was made of vinyl, rubber, or other appropriate non-slip material.

One reason that the connection between cradle shaft 8 and cradle 4, and between foot shaft 12 and foot 14, is pivotal, is so that if small lateral adjustments must be made to the position of wall panel 32 relative to wall 38, or if the angle of wall panel 32 relative to floor 40 must undergo minor adjustment, then the pivotal nature of these attachments permits this wall panel 32 positional "fine-tuning".

Method of Wall Panel Installation:

A. Placing suction cup handle 36 in cradle groove 6.

B. Positioning wall panel jack 2 vertically, cradle 4 topmost, with foot pad 16 on floor 40 and suction cup 34 against wall panel 32.

C. Moving foot 14 away from wall 38 until wall panel jack 2 is disposed at an angle of 5–7 degrees relative to wall 38.

D. Attaching suction cup 34 to wall panel 32 in the conventional manner.

E. Lifting wall panel 32 into a position slightly higher than it's intended installed height, by rotating turnbuckle 10.

F. Placing correctly-sized blocks on floor 40 under wall panel 32.

G. Lowering wall panel 32 onto the blocks by rotating turnbuckle 1O.

H. Permanently fastening wall panel 32 on wall 38.

While a preferred embodiment of the invention has been illustrated herein, it is to be understood that changes and variations may be made by those skilled in the art without departing from the spirit of the appending claims.

DRAWING ITEM INDEX wall panel jack
cradle
cradle aperture
cradle groove
arrow
cradle shaft
cradle shaft thread
turnbuckle
cradle dowel
foot shaft
foot shaft thread
foot
footpad
foot dowel
foot aperture
turnbuckle bore
turnbuckle bore cradle thread
turnbuckle bore foot thread
arrow
arrow
wall panel
suction cup
suction cup handle
wall
floor
arrow

I claim:

1. A wall panel jack comprising a turnbuckle connecting a cradle shaft to a foot shafts, a cradle comprising a cradle groove pivotably attached to an extreme of said cradle shaft opposite said turnbuckle, and a foot pivotably attached to an extreme of said foot shaft opposite said turnbuckle, said turnbuckle comprising a turnbuckle bore, a turnbuckle bore cradle thread disposed on an upper part of said turnbuckle bore, a turnbuckle bore foot thread disposed on a lower part of said turnbuckle bore, a sense of rotation of said turnbuckle bore cradle thread being opposite a sense of rotation of said turnbuckle bore foot thread, a cradle shaft thread on said cradle shaft sized to mate with said turnbuckle bore cradle thread, and a foot thread on said foot shaft sized to mate with said turnbuckle bore foot thread, said cradle further comprising a cradle aperture, a pivot range of said cradle shaft relative to said cradle being bounded by walls of said cradle aperture, said cradle shaft pivot range extending to ±5 degrees from perpendicular relative to said cradle groove.

2. The wall panel jack of claim 1 wherein said foot further comprises a foot pad.

3. The wall panel jack of claim 2 wherein a lower surface of said foot pad is shaped substantially like a half-cylinder.

4. A wall panel jack comprising a turnbuckle connecting a cradle shaft to a foot shaft, a cradle comprising a cradle groove pivotably attached to an extreme of said cradle shaft opposite said turnbuckle, and a foot pivotably attached to an extreme of said foot shaft opposite said turnbuckle, said turnbuckle comprising a turnbuckle bore, a turnbuckle bore cradle thread disposed on an upper part of said turnbuckle bore, a turnbuckle bore foot thread disposed on a lower part of said turnbuckle bore, a sense of rotation of said turnbuckle bore cradle thread being opposite a sense of rotation of said turnbuckle bore foot thread, a cradle shaft thread on said cradle shaft sized to mate with said tumbuckle bore cradle thread, and a foot thread on said foot shaft sized to mate with said turnbuckle bore foot thread, said foot further comprising a foot aperture, relative to said foot being bounded by walls of said foot aperture, said foot shaft pivot range extending to ±5 degrees from perpendicular relative to said foot pad.

5. The wall panel jack of claim 4 further comprising a cradle dowel disposed within said cradle aperture, said cradle shaft being pivotally connected to said cradle by means of said foot dowel.

6. The wall panel jack of claim 5 further comprising a foot dowel disposed within said foot aperture, said foot shaft being pivotally connected to said foot by means of said foot dowel.

* * * * *

UNITED STATES PATENT AND TRADEMARK OFFICE

CERTIFICATE OF CORRECTION

PATENT NO. : 5,971,362
DATED : October 26, 1999
INVENTOR(S) : Marshall C. Clark

It is certified that error appears in the above-identified patent and that said Letters Patent is hereby corrected as shown below:

| | |
|---|---|
| Column 3 line 11 | "...which wall 32..." *should read* "..which wall panel 32..." |
| Column 4 line 18 | "...wall panel jack" *should read* "...2 wall panel jack..." |
| Column 4 line 19 | "...cradle..." *should read* "...4 cradle..." |
| Column 4 line 20 | "...cradle aperture..." *should read* "...5 cradle aperture..." |
| Column 4 line 21 | "...cradle groove..." *should read* "...6 cradle groove..." |
| Column 4 line 22 | "...arrow..." *should read* "...7 arrow..." |
| Column 4 line 23 | "...cradle shaft" *should read* "...8 cradle shaft..." |
| Column 4 line 24 | "...cradle shaft thread" *should read* "...9 cradle shaft thread..." |
| Column 4 line 25 | "...turnbuckle" *should read* "...10 turnbuckle..." |
| Column 4 line 26 | "...cradle dowel" *should read* "...11 cradle dowel..." |
| Column 4 line 27 | "...foot shaft" *should read* "...12 foot shaft..." |
| Column 4 line 28 | "...foot shaft thread" *should read* "...13 foot shaft thread..." |
| Column 4 line 29 | "...foot" *should read* "...14 foot..." |
| Column 4 line 30 | "...footpad" *should read* "...16 footpad..." |
| Column 4 line 31 | "...foot dowel" *should read* "...18 foot dowel..." |
| Column 4 line 32 | "...foot aperture" *should read* "...20 foot aperture..." |
| Column 4 line 33 | "...turnbuckle bore" *should read* "...22 turnbuckle bore..." |
| Column 4 line 34 | "...turnbuckle bore cradle thread" *should read* "...24 turnbuckle bore cradle thread..." |
| Column 4 line 35 | "...turnbuckle bore foot thread" *should read* "...26 turnbuckle bore foot thread..." |

UNITED STATES PATENT AND TRADEMARK OFFICE

CERTIFICATE OF CORRECTION

PATENT NO. : 5,971,362
DATED : October 26, 1999
INVENTOR(S) : Marshall C. Clark

It is certified that error appears in the above-identified patent and that said Letters Patent is hereby corrected as shown below:

| | |
|---|---|
| Column 4 line 36 | "...arrow" *should read* "...28 arrow..." |
| Column 4 line 37 | "...arrow" *should read* "...30 arrow..." |
| Column 4 line 38 | "...wall panel" *should read* "...32 wall panel..." |
| Column 4 line 39 | "...suction cup" *should read* "...34 suction cup..." |
| Column 4 line 40 | "...suction cup handle" *should read* "...36 suction cup handle..." |
| Column 4 line 41 | "...wall" *should read* "...38 wall..." |
| Column 4 line 42 | "...floor" *should read* "...40 floor..." |
| Column 4 line 43 | "...arrow" *should read* "...42 arrow..." |
| Column 4 line 46 | "...to a foot shafts..." *should read* "...to a foot shaft..." |
| Column 6 line 1 | "...aperture, relative to..." *should read* "...aperture, a pivot range of said foot shaft relative to... |

Signed and Sealed this

Twentieth Day of June, 2000

*Attest:*

Q. TODD DICKINSON

*Attesting Officer*

*Director of Patents and Trademarks*